United States Patent [19]

Hardie

[11] Patent Number: 4,565,188

[45] Date of Patent: Jan. 21, 1986

[54] VIBRATORY SAUNA

[75] Inventor: Laurie S. Hardie, 8 View Ave., Surfers Paradise, Queensland, Australia

[73] Assignees: Laurie Stanley Hardie, Surfers Paradise; Leonard John Coleman, Paradise Waters, both of Australia

[21] Appl. No.: 551,958

[22] Filed: Nov. 15, 1983

[30] Foreign Application Priority Data

Nov. 23, 1982 [AU] Australia ..... PF6935

[51] Int. Cl.[4] ..... A61A 21/00

[52] U.S. Cl. ..... 128/24.2; 128/33; 128/368; 4/530; 4/524

[58] Field of Search ..... 128/24 R, 24.1, 24.2, 128/33, 368, 376, 374; 4/524, 529, 530, 531

[56] References Cited

U.S. PATENT DOCUMENTS

| | | | |
|---|---|---|---|
| 1,797,153 | 3/1931 | Nogradi | 4/529 |
| 2,096,128 | 10/1937 | Mortrude, Jr. | 128/24.1 |
| 2,235,184 | 3/1941 | Wettlaufer | 128/334 |
| 2,500,508 | 3/1950 | Bachin | 128/24.1 |
| 2,814,297 | 11/1957 | Stewert | 4/531 |
| 3,826,250 | 7/1974 | Adams | 128/24.2 |

*Primary Examiner*—Richard J. Apley
*Assistant Examiner*—David J. Brown
*Attorney, Agent, or Firm*—Lackenbach Siegel Marzullo Presta & Aronson

[57] ABSTRACT

A vibratory sauna including a housing having a closure member associated therewith which comprises a base and continuous side wall. There is also provided resilient mounting means for mounting the support member in or on the housing and vibration means for causing vibration of the support member. There is also provided a chamber in the housing located below the support member which has heating means such as a heated element and airflow generation means such as a fan associated therewith.

The arrangement is such that heated air may be caused to flow out of the chamber and above the support member to contact the person resting on the support member while the support member is being vibrated by the vibration means. Afterwards the heated air may be returned to the chamber to provide a continuous circulation of heated air throughout the housing.

15 Claims, 7 Drawing Figures

VIBRATORY SAUNA

This invention relates to a vibratory sauna and in particular to a sauna suitable for providing vibrating motion to a person using the sauna which ensures relaxation and enjoyment of the sauna while in use.

Hitherto conventional saunas have comprised fixed housing having a hinged cover thereby allowing a person using the sauna to gain access. The person was usually treated to a passage of hot air or steam while being confined in the sauna housing and it was usually found that sauna treatment resulted in a user having a period of relaxation while the muscles and skin were subject to a "toning up" or gentle cleansing process. Saunas were also believed to improve blood circulation.

In another type of sauna a person was subject to a steam bath in a room heated to above average temperature.

In yet another type of sauna a person could relax in a shallow bath while having pressurized jets of water directed at various parts of his body.

While these conventional saunas as described above have been found to be generally satisfactory, disadvantages that were found included the user of the sauna not being able to experience complete relaxation because of the fact that his body was normally stationary and often a cramped feeling resulted. This normally meant the user frequently changing his position in relation to the latter type of saunas described above and only remaining in the first type of conventional sauna as described above for a relatively short period of time.

It is therefore an object of the invention to provide a vibratory sauna which alleviates the abovementioned difficulties associated with the prior art.

The vibratory sauna of the invention includes:

a housing having a closure member associated therewith and comprising a base and continuous side wall;

a support member;

resilient mounting means for mounting said support member in or on said housing;

vibration means for causing vibration of said support member; and a chamber in said housing located below said support member and having heating means and air flow generation means associated therewith;

the construction and arrangement being that heated air may be caused to flow out of said chamber and above said support member to contact a person resting on said support member while said support member is being vibrated by said vibration means whereafter said heated air may be returned to said chamber to provide a continuous circulation of heated air throughout said housing.

Preferably the support member includes an elongate mattress, mat or sheet. However suitably the support member may be in the form of an elongate plate suitably covered with a layer of resilient material. Alternatively the support plate may be manufactured from resilient material such as natural or synthetic rubber or resilient plastics material.

The vibrating means may be of any suitable type that may result in vibration of the support member. In one form the support member may be mounted on mounting rollers which may rotate upon actuation of a suitable drive means.

Alternatively the support member may be vibrated by an endless belt passing underneath the support member.

Preferably however the vibrating means includes a motor or engine which is preferably an electric motor rigidly attached to the support member and suitably the underside thereof. The motor may have an output shaft to which is attached a vibration member or eccentric.

The support member is loosely or resiliently mounted in the sauna housing so that it is vibrated. One form of mounting means suitable for this purpose is the provision of resilient means, such as mounting balls or pads supported in the housing which may pivot or rotate relative to the housing. Preferably each mounting ball or pad is supported on a suitable recess in the sauna housing and contacts or bears against a retaining recess in the underside of the support member.

The arrangement is suitably such that as the output shaft of the electric motor rotates, the eccentric attached thereto will cause the support member to vibrate being only loosely or resiliently mounted in the sauna housing.

The sauna housing may be of any suitable type and thus may include a rectangular or oval box having an open top. The housing may be supported by an appropriate support frame wherein the vertical members of the frame may comprise appropriate support legs for the housing. The housing may be portable if desired but is suitably such that it is stationary or mounted to a fixed position.

The sauna housing may also include a hinged cover plate or lid which may be pivoted away from the open top thereof to allow access to the interior of the housing.

The housing may support the support member wherein the support member is located adjacent the open top. Underneath the support member in the housing there is provided the chamber wherein there may be located the air flow generation means and the heating means. Appropriate heating means for this purpose may include a heating element or electrical element and the air flow generation means may include air blowers or fans for circulation of hot air throughout the housing.

If desired the sauna housing may also have humidifying means associated therewith. In one form there may be provided a shallow container which is located in a base part of the housing which may contain water in contact with a suitable absorbent such as a sheet of sponge material.

Reference may be made to a preferred embodiment of the invention as shown in the attached drawings wherein.

Figure 1:
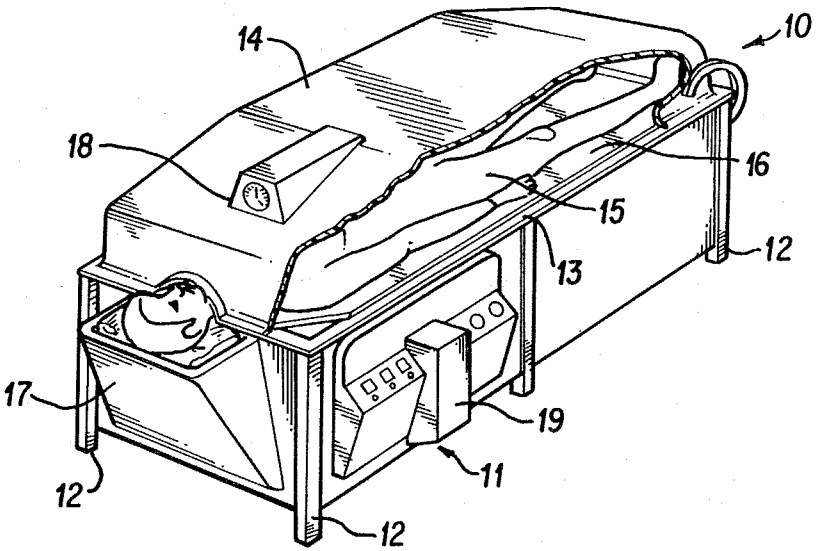
FIG. 1 is a perspective view of a sauna constructed in accordance with the invention and the sauna is shown in an operative position.

The sauna shown in the drawings includes a sauna housing 10 having a support frame 11 including support legs 12 and a peripheral frame member 13. Hingedly attached to housing 10 is a cover 24 broken away in FIG. 1 to show a person 15 resting on support plate 16. There is also shown a head support or pillow 17, thermometer 18 and control panel 19.

Figure 2:
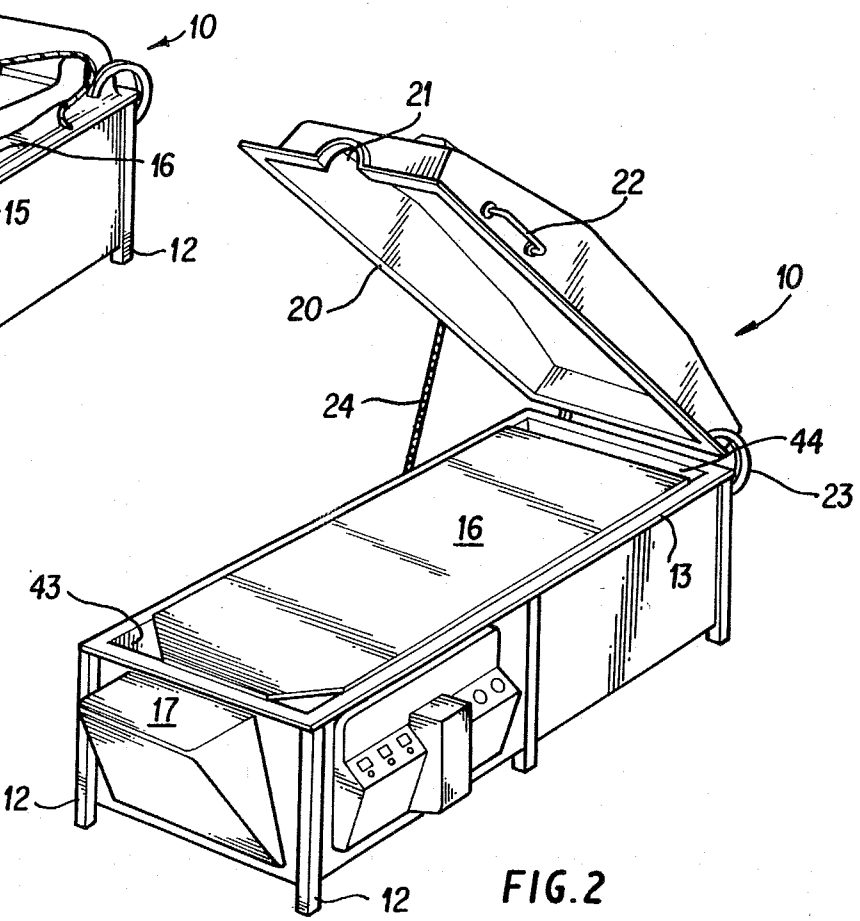
FIG. 2 is a perspective view of the sauna shown in FIG. 1 belt shown in an inoperative position.

Cover 14 includes a peripheral flange 20 for engaging with peripheral frame member 13 and a head opening 21 as well as handle 22. Hinges 23 interconnect flange 20 and frame member 13 as shown in FIG. 2. Chains 24 also interconnect cover 14 and sauna housing 10.

Figure 3:
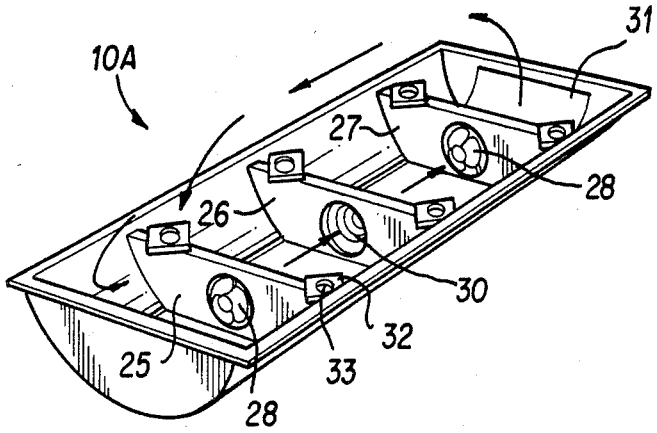
FIG. 3 is a perspective view of the sauna shown in FIG. 1 with the support member removed for clarity.
Figure 7:
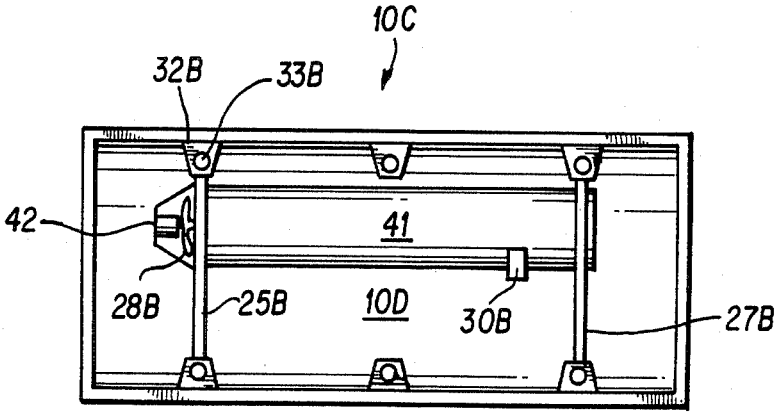
FIG. 7 is a plan view of a modified sauna constructed in accordance with the invention with the support member removed for clarity.
Figure 4:
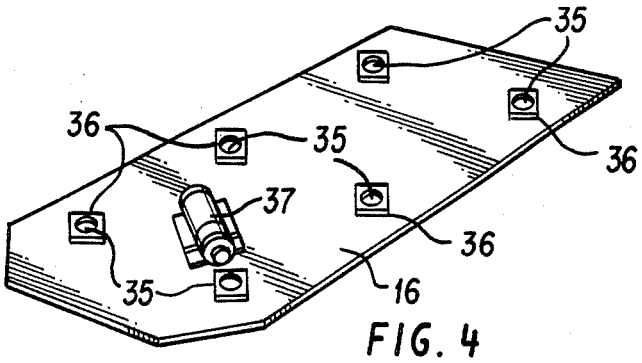
FIG. 4 is a detailed view of the support member.
Figure 5:
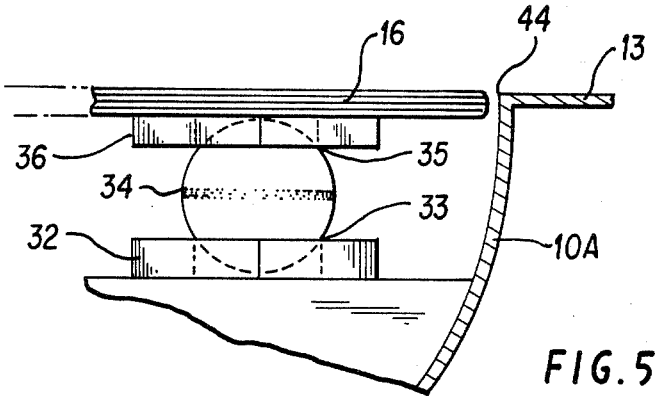
FIG. 5 is a detailed view of the resilient mounting means utilized to mount the support member within the sauna housing.
Figure 6:
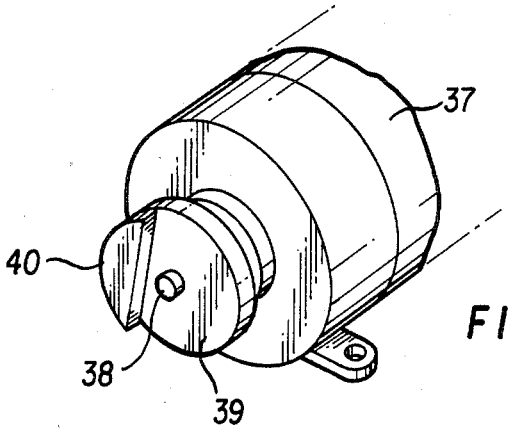
FIG. 6 is a detailed view of the vibration means.

In FIG. 3 there is shown a trough 10A which is a basic component of sauna housing 10 having a chamber wherein the arrows indicate the flow path of the hot air circulating therein, and the chamber further comprising a plurality of chambers, such as, for example, illustrated in FIGS. 3 and 7. There is also provided transverse baffles 25, 26 and 27. Baffles 25 and 27 are useful for mounting of fans 28 and central baffle 26 is utilized for mounting of heating element 30. End baffle 31 is used to deflect air flow upwardly as shown. There is also provided lower mounting members 32 having recesses 33 for balls 34 which also engage in recesses 35 of upper mounting members 36 attached to the underside of support plate 16.

The support member 16 also includes an electric motor 37 bolted to the underside thereof having an output shaft 38. Attached to output shaft 38 is a mounting plate 39 having vibration member or eccentric 40 attached thereto. Vibration of member 40 upon rotation of shaft 38 in turn causes vibration of support plate 16 which is resiliently mounted on balls 34 as described previously. This provides a gentle vibration which has a soothing and relaxing effect on the person using the sauna and hence for this reason it is believed that the vibrating sauna of the invention is an advance over the prior art.

In FIG. 7 there is shown a modified trough 10C having chamber 10D contained therein. There is also shown mounting sockets 33B located in brackets of lugs 32B for balls or pads 34 described previously. Also shown is a chambler or tunnel 41 having fan or blower 28B located in one end in partition 25B as shown. Also shown is the other end partition 27B of tunnel 41. There is also shown electrical socket 30B for activation of a heating element (not shown) in tunnel 41 and another electrical socket 42 for activation of fan 28B.

The vibratory sauna of the invention is also useful in that the person 15 may have tried muscles and wound up nerves relaxed in the gentle message of the sensual vibration and passive heat combinations.

The vibratory sauna of the invention is a unique concept and works on the principle of heating the body while the vibration stimulates body movement giving the simulated effect of exercising. Depending upon the metabolism of the user the vibratory sauna of the invention may be programmed to simulate the results of a jog or brisk wall. Thus the vibratory sauna of the invention is to assist people unable to participate in active exercise. The principle of the invention is help in the breakdown of fat cells and the removal of surplus body fluids. Therapeutic effects such as relief from backache, tired muscles, arthritis, tension, soreness and insomnia may also be achieved by the vibratory sauna of the invention.

It will also be noted from the drawings that the support member 16 is spaced from the peripheral flange 13 by spaces 43 and 44 so as to facilitate the continuous circulation of heated air previously described.

I claim:

1. A vibratory sauna comprising:

a housing having a closure member associated therewith and comprising a base and continuous side wall;

a support member oriented in a substantially horizontal plane for supporting a patient in a supine position;

head support means located adjacent the housing and outwardly of said closure member to form a longitudinal extension of the support member;

resilient mounting means for supporting said support member;

vibration means for vibrating said support member;

a chamber in said housing located below said support member and containing heating means and airflow generation means, and said chamber further comprising a plurality of chambers, means in said chamber for providing longitudinal flow of heated air in a continuous loop manner, whereby heated air may be caused to flow in and out of said chamber at opposite ends thereof, and to flow above said support member to contact a person lying thereon while said support member is adapted to be simultaneously vibrated; and said heated air being returned to said chamber to form a closed circulation loop of heated air throughout said housing.

2. A vibratory sauna as claimed in claim 1, wherein said closure member of said sauna is a lid hingedly mounted to said continuous side wall.

3. A vibratory sauna as claimed in claim 1, wherein said support member comprises an elongate member.

4. A vibratory sauna as claimed in claim 3, wherein said resilient mounting means includes resilient means interposed between the elongate member and said housing.

5. A vibratory sauna as claimed in claim 1, further including a plurality of sockets provided in said elongate member and in said housing for mutual cooperative association with said resilient means.

6. A vibratory sauna as claimed in claim 3, wherein said vibration means includes a motor rigidly attached to the underside of said elongate member having an output shaft with an eccentric mounted thereon.

7. A vibratory sauna as claimed in claim 3, wherein said chamber includes a tubular member containing said air generation means and said heating means and through which said heated air flows on passage through said chamber.

8. A vibratory sauna as claimed in claim 7, wherein the air flow generation means is a fan located in said tubular member and said heating means is an electrical element included in said tubular member.

9. A vibratory sauna as claimed in claim 1, including a plurality of baffles in said chamber, each baffle having an aperture, and each aperture in said chamber being in substantial alignment for providing said longitudinal flow of heated air.

10. A vibratory sauna as claimed in claim 9, wherein one aperture of a baffle contains heating means and another aperture in a second baffle contains said air flow generation means.

11. A vibratory sauna according to claim 1, wherein said means in said chamber for providing a longitudinal flow of heated air is a horizontal tunnel-like device.

12. A vibratory sauna as claimed in claim 1, including humidifying means associated therewith in the form of an absorbent material soaked with water suitably disposed in said housing.

13. A vibratory sauna as claimed in claim 5, wherein said resilient means are balls seated in said sockets.

14. A vibratory sauna as claimed in claim 2, wherein said lid is hinged to said continuous side wall at an end of said housing opposite to said head support means.

15. A vibratory sauna as claimed in claim 1, further including a control panel for said vibratory sauna, whereby settings may be made for airflow, vibration and temperature.

* * * * *